United States Patent [19]

McKee

[11] 4,129,388

[45] Dec. 12, 1978

[54] VIBRATOR FOR FLOWING GRANULAR MATERIAL

[76] Inventor: Ronald H. McKee, 2614 N. Galvez St., New Orleans, La. 70117

[21] Appl. No.: 818,622

[22] Filed: Jul. 25, 1977

[51] Int. Cl.[2] ..... B06B 1/18
[52] U.S. Cl. ..... 366/124
[58] Field of Search ..... 366/108, 116, 124

[56] References Cited

U.S. PATENT DOCUMENTS

| | | | |
|---|---|---|---|
| 2,472,568 | 6/1949 | Burt | 366/116 |
| 3,917,233 | 11/1975 | Blower | 366/124 |
| 3,945,613 | 3/1976 | Jysky | 366/124 |

*Primary Examiner*—Edward J. McCarthy
*Attorney, Agent, or Firm*—James B. Lake, Jr.

[57] ABSTRACT

A reciprocating pneumatic piston vibrator for flowing granular materials is cushioned at an impact and by an elastomer and at the other end by air for reducing the decibel level while transmitting sufficient impact force to begin and maintain granular material flow.

3 Claims, 4 Drawing Figures

VIBRATOR FOR FLOWING GRANULAR MATERIAL

BACKGROUND OF THE INVENTION

The invention relates in general to piston vibrators employed to cause ordinarily non-flowing granular materials to move and more particularly to a pneumatic piston vibrator of the impact type combining great force with low decibel noise level during operation.

Not all materials flow unaided through troughs, chutes, bins or hoppers with the speed desired. It has long been recognized that pneumatic piston vibrators fixed to one of the above enumerated retainers along which the material is meant to flow will accelerate the materials' movement by relaying the force of impact of a reciprocating piston housed inside a vibrator piston chamber, through the vibrator housing mounted on the retainer surface to the material itself.

Pneumatic piston vibrators are of various generic types classed by the mode of cushioning of the piston in the vibrator piston chamber. Impact pneumatic piston vibrators allow the piston to strike the chamber extremity at one end of the stroke while preventing impact at the other end of the stroke by means of a cushion of pressurized air. The silent pneumatic piston vibrator introduces a cushion of pressurized air at each end of the piston stroke, preventing piston impact at either end of the piston chamber.

Some of the problems and requisites that should be considered in designing a pneumatic piston vibrator are as follows:

The vibrator housing transmits force to the material sought to be moved. The piston generates that force. The greater the force, the greater the material influencing efficiency of the vibrator. The impact type piston strikes the piston chamber extremity directly and thereby generates force in the area of 107 lbs. The silent type piston never strikes either chamber extremity. The pressurized air cushion reduces the force generated to the area of 100–1000 lbs.

The Occupational Safety and Health Administration has promulgated regulations on the noise level in decibels acceptable in industrial occupational settings. That decibel limit is currently approximately 90 dba. An impact vibrator will produce noise in the area of 105–110 dba. A silent type vibrator will produce approximately 40–65 dba.

Both types of pneumatic piston vibrators offer problems. By allowing the piston to strike a chamber extremity, the impact type generates more impact force and a more efficient material influencing vibrator but the decibel level is high and unacceptable. The silent type pneumatic piston vibrator has significantly lower decibel level but the cushioning effect of the pressurized air produces a correspondingly low force of impact to be transmitted to the material.

SUMMARY OF THE INVENTION

It is therefore an object of this invention to provide a pneumatic piston vibrator which will produce the maximum usable impact force at a decibel level acceptable to the the Occupational Safety and Health Standards and safe and comfortable to the user.

Other objects and a fuller understanding of the invention may be had by referring to the following description and claims taken in conjunction with the accompanying drawings in which:

DETAILED DESCRIPTION

Figure 1:
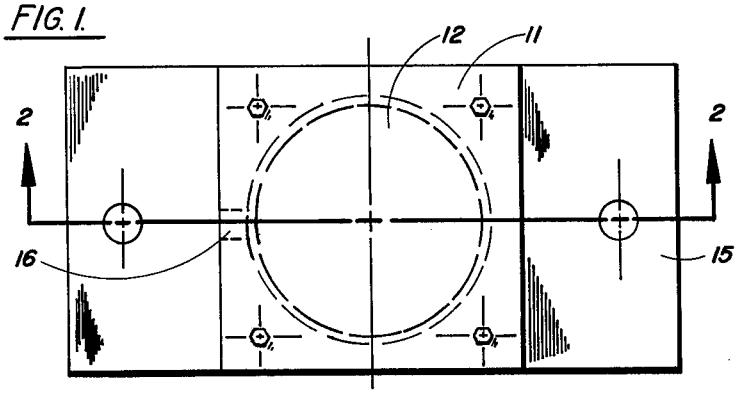
FIG. 1 is a plan view of the invention.
Figure 2:
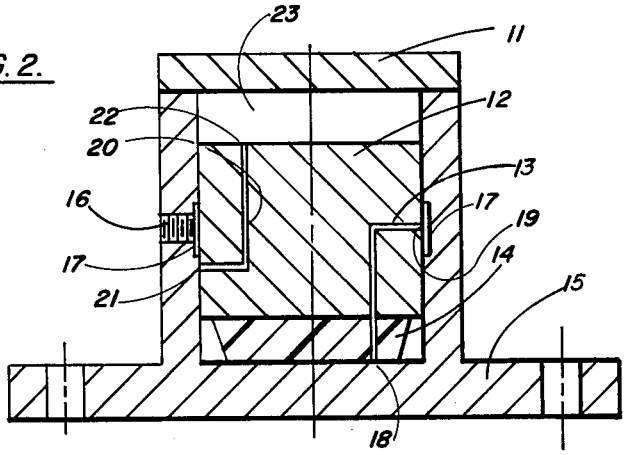
FIG. 2 is a cross-sectional view taken along section 2—2 of FIG. 1.

With reference to the drawings, FIGS. 1 and 2, the invention comprises an impact pneumatic piston vibrator having a vibrator housing 15 with a base at one end and defining an open piston cylinder chamber 23 at the other. A cylinder head 11 attaches to the vibrator housing and seals the piston cylinder 23 at the open end. The base end of the piston cylinder takes the impact of a cylindrical piston 12 which slidably reciprocates in the piston cylinder 23 through the introduction of air under pressure. The air reaches the cylinder 23 by means of an entry fitting and channel 16 penetrating the housing 15 side and communicating to a peripheral air passage 17 grooved around the circumference of the interior cylinder wall at its longitudinal midpoint. To direct the pressurized air in the cylinder the piston 12 defines a pair of air conduits, 13 and 20 each with an inlet port 19 and 21 at the piston side and an exit port 18 and 22 at an oppositely disposed piston end. Each air conduit 13 and 20 has its inlet port 19 and 21 positioned along the piston side beyond the midpoint and opposite that piston end on which its exit port 18 and 22 is located. An elastomer 14 prevents the piston end from directly striking the impact end of the piston chamber.

In operation, pressurized air flows through the air entry fitting 16 into the peripheral air passage 17 and engages one of the two air directional conduit inlet ports 19 and 21 on the piston 12. (For this explanation, conduit 13 will be used, but it must be understood that the same sequence applies equally to both conduits 13 and 20.) The pressurized air passes through the conduit 13 in the piston 12 to its exit port 18, rapidly filling the space between piston end and cylinder end, thereby building up pressure necessary to thrust piston 12 along the cylinder in the opposite direction. The piston's 12 movement disengages the peripheral air passage 17 and inlet port 19 cutting off entry of pressurized air to the conduit 13 and the piston cylinder. The thrust carries the piston 12 until the peripheral air passage 17 engages the second inlet port 21. Pressurized air flows through the conduit 20 to its exit port 22 at the leading end of the moving piston 12 filling the space between the piston end and cylinder end thereby slowing, stopping and reversing the piston 12. The reverse movement disengages the peripheral air passage 17 from the second inlet port 21 and delivers the piston 12 to impact, aligning the peripheral air passage 17 with the first inlet port 19 and completing the piston cycle.

The length of the piston stroke is determined by the placement of the inlet ports 19 and 21 relative to each other along the piston sides. The pneumatic vibrator illustrated is an impact type. The piston 12 travels and strikes one end of the piston cylinder before the first side inlet port is engaged. At the other end of the piston stroke, however, the second inlet port is engaged before the piston strikes the cylinder end, thereby delivering pressurized air into the space between piston and cylinder end, effectively slowing, stopping and then thrusting the piston away before impact.

Figure 3:
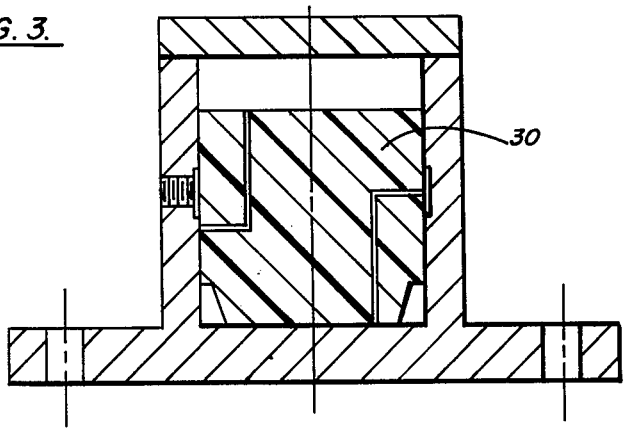
FIG. 3 is similar to FIG. 2 showing another embodiment of the invention, as is FIG. 4.
Figure 4:
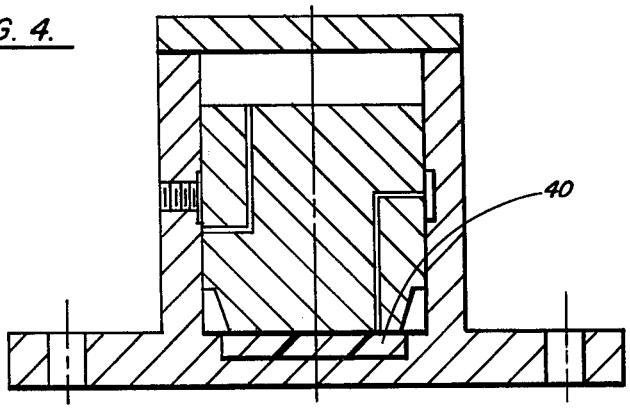

In addition to the cushion of pressurized air, the invention introduces an elastomer at the impact end of the piston stroke. Such an elastomer allows the piston impact to be carried with minimum dissipation directly to the vibrator housing thence to the material to be influenced, while reducing the decibel level of noise created on impact. The elastomer may be on either impact surface, attached to the piston (See FIG. 2 at 14) or the piston cylinder end (See FIG. 4 at 40). The piston itself may be wholly constructed of the elastomer (See FIG. 3 at 30) or various configurations of plugs or pads may be employed. Anti-friction material along the sides of piston or cylinder may be introduced to improve efficiency. Whatever configuration is ultimately employed, the impact will generate a noise decibel level lower than if the elastomer were absent and one acceptable to the Occupational Safety and Health Administration and industry.

What is claimed is:

1. An impact type pneumatic piston vibrator comprising in combination:

(a) a vibrator housing defining an elongated cylinder with round walls and oppositely disposed closed ends, and a base normal to said cylinder at one of said closed ends for attaching said vibrator housing to an exterior surface of any containing means for granular material;

(b) a peripheral air passage defined interiorly in said round walls intermediate said cylinder closed ends for receiving compressed air;

(c) means for introducing compressed air through said cylinder circular wall into said peripheral air passage;

(d) an elongated piston slidably mounted in said cylinder and adapted to be reciprocated between said oppositely disposed closed ends thereof, said piston defining two air conduits between said air passage and respective piston ends for alternate registration with said peripheral air passage for the greater part of piston reciprocation toward and away from said base, and for registration of both said air conduits with said peripheral air passage for a lesser part of piston reciprocation near the closed end of said cylinder oppositely disposed from said base closed end for air cushioning the piston at said oppositely closed end in its reciprocation in said cylinder; and (e) a resilient elastomer material adapted to be mounted between said base closed end of said cylinder and the adjacent piston end for absorbing a noise of impact and little of the force of impact of said piston on said base end adjacent said containing means for granular material.

2. An impact type pneumatic vibrator as described in claim 1 wherein said elastomer is mounted on the end of said piston adjacent the one closed end of said cylinder.

3. An impact type pneumatic vibrator as described in claim 1 wherein said elastomer material is mounted on said one closed end of said cylinder.

* * * * *